United States Patent [19]

Connerney et al.

[11] 4,020,427

[45] Apr. 26, 1977

[54] FOAM MATCHING LOAD

[75] Inventors: William R. Connerney, Needham; Denis L. Bourassa, Methven, both of Mass.

[73] Assignee: The United States of America as represented by the Secretary of the Army, Washington, D.C.

[22] Filed: May 17, 1976

[21] Appl. No.: 686,766

[52] U.S. Cl. ..... 333/22 R; 333/81 B

[51] Int. Cl.[2] ..... H01P 1/26

[58] Field of Search ..... 333/81 B, 22 R, 22 F, 333/98 R

[56] References Cited

UNITED STATES PATENTS 2,908,875 10/1959 Blatt et al. ..... 333/22 R

*Primary Examiner*—Paul L. Gensler

*Attorney, Agent, or Firm*—Nathan Edelberg; Robert P. Gibson; Robert C. Sims

[57] ABSTRACT

A waveguide matched load device comprising a short-circuited rectangular section with an energy absorbing material located approximately ¼ of a wavelength from the short-circuited end.

2 Claims, 1 Drawing Figure

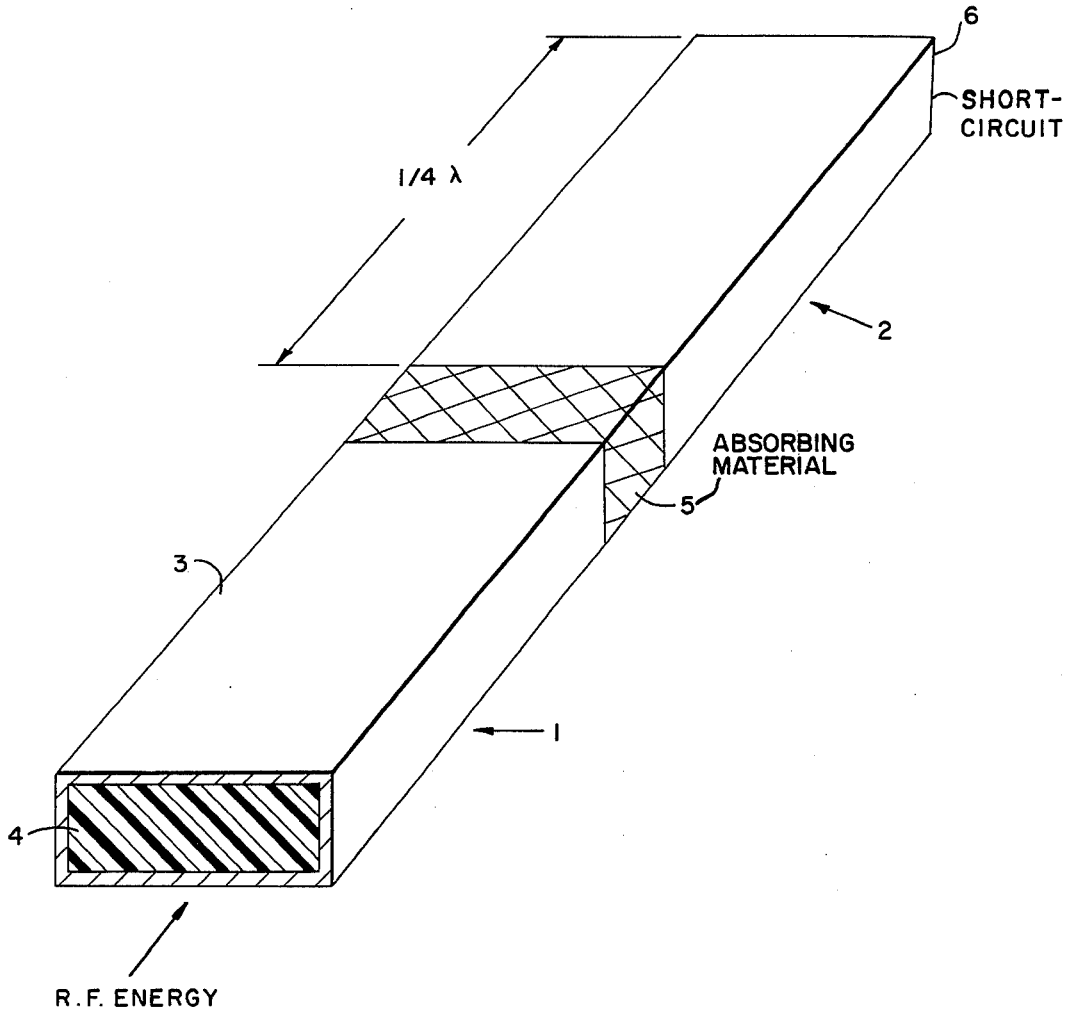
6
SHORT-
CIRCUIT
1/4 λ
2
ABSORBING
MATERIAL
5
3
1
4
R.F. ENERGY

FOAM MATCHING LOAD

SUMMARY OF THE INVENTION

A waveguide matched load device comprising: a rectangular waveguide used to introduce R.F. energy to a R.F. energy absorbing material which is appropriately attached to one end of this waveguide and a second rectangular waveguide used for termination of the load device. This second waveguide has one end connected to the absorbing material and the other end short-circuited. Both waveguide sections are fabricated by plating a thin film of metallic coating, such as copper, onto a preformed polystyrene foam dielectric material. Such fabrication of the device presents a 5 to 1 savings in fabrication 3 to 1 savings in fabrication cost as compared with waveguides constructed of a thin wall of copper or aluminum with an air dielectric.

BRIEF DESCRIPTION OF THE DRAWING

The single FIGURE is a diagrammatic showing of the present invention.

DESCRIPTION OF THE PREFERRED EMBODIMENT

A matched load is a terminating device having an impedance value that results in maxiumum absorption of energy. Such is shown by the single FIGURE. The waveguides 1 and 2 are fabricated by coating a thin film of copper 3 onto a preformed foam polystyrene material 4 to thereby form a rectangular waveguide for transmission of the undersired R.F. energy to an absorbing material 5 such as a thin film resistive card. Waveguide 2 is fabricated in like manner and has one of its ends 6 short-circuited and the other end attached to the absorbing material. The thin film resistive card is attached to the copper plated waveguides by an nonmetallic epoxy.

Short-circuited waveguide 2 is approximately a quarter wavelength (or an electrically multiple quarter wavelength) of the frequency of the R.F. input energy. This locates the thin film resistive card 5 at a point of current peak, since the reflected radiation from the short-circuited end reaches card 5 in phase with the incoming R.F. radiation. Waveguide 1 is used to join the load to its mating section (i.e., another R.F. component or energy source not shown.)

In operation the R.F. radiation travels through waveguide 1 to thin film resistive card 5 which absorbs most of the radiation. Some radiation travels on through waveguide 2 to its short-circuited end and is reflected back to the thin film resistive card 5. Since the resistive card is located a distance equal to approximately one quarter of a wavelength of the radiation away from the shorted end, the reflected radiation will reach card 5 on its return trip in phase with the incoming radiation. This allows resistive card 5 to pick up most of the radiation without distortion or attenuation.

I claim:

1. A waveguide matched load device for a predetermined frequency of radiation comprising an elongated, rectangular cross-sectioned polystyrene foam dielectric material; a thin film of metallic material coating the outside of the elongated dimension of said material; one end of said material being shorted-circuited; an energy absorbing means connected at the other end of said material; and further means connected to said energy absorbing means to supply the predetermined frequency of radiation.

2. A device as set forth in claim 1 wherein said dielectric material and thin film of metallic material form a waveguide which is approximately ¼ of a wavelength of said predetermined frequency in length; and said energy absorbing means is a thin film resistive card.

* * * * *